US006040278A

United States Patent [19]

Kok et al.

[11] Patent Number: 6,040,278

[45] Date of Patent: Mar. 21, 2000

[54] WATER-FREE RELEASE/LUBRICATION AGENT FOR TREATING THE WALLS OF A DIE FOR ORIGINAL SHAPING OR RESHAPING

[75] Inventors: Douwe Marten Kok, Scheemda; Harold Gankema, Groningen, both of Netherlands

[73] Assignee: Acheson Industries, Inc., Port Huron, Mich.

[21] Appl. No.: 09/159,199

[22] Filed: Sep. 23, 1998

[30] Foreign Application Priority Data

Mar. 9, 1998 [DE] Germany ..... 198 10 031

[51] Int. Cl.[7] ..... C10M 111/04

[52] U.S. Cl. ..... 508/208; 508/212; 508/214; 508/312; 508/315; 585/10; 585/12

[58] Field of Search ..... 508/208, 212, 508/214, 312, 315; 585/10, 12

[56] References Cited

U.S. PATENT DOCUMENTS

| | | | |
|---|---|---|---|
| 1,163,856 | 12/1915 | Rice | 508/491 |
| 1,874,956 | 8/1932 | Gallsworthy | 508/312 |
| 2,742,428 | 4/1956 | Agens | 508/212 |
| 3,095,375 | 6/1963 | Pitman | 508/312 |
| 3,600,310 | 8/1971 | Eyres et al. | 508/491 |
| 4,168,241 | 9/1979 | Kozima et al. | 508/175 |
| 4,670,174 | 6/1987 | Mirkin | 508/491 |
| 4,800,033 | 1/1989 | Stetter | 508/312 |
| 5,691,286 | 11/1997 | Stepan | 508/491 |

*Primary Examiner*—Margaret Medley
*Attorney, Agent, or Firm*—Dinnin & Dunn, PC

[57] ABSTRACT

A water-free composition for treating the walls of a die for original shaping or reshaping contains up to 30% of a polyolefin and/or paraffin wax and at least 70% of oil, where the oil is a silicone oil, a synthetic oil, a vegetable oil, a mineral oil, or a blend of several such oils. To produce a water-free composition according to the invention, one or more waxes are mixed with the oil or oils and any additives desired until a homogeneous mixture is obtained. The water-free release/lubricating agents according to the invention are used especially to treat the walls of a die for shaping or reshaping.

13 Claims, No Drawings

WATER-FREE RELEASE/LUBRICATION AGENT FOR TREATING THE WALLS OF A DIE FOR ORIGINAL SHAPING OR RESHAPING

The present invention pertains to water-free compositions for treating the walls of a die for original shaping or reshaping, to their production, and to their use.

Conventional release agents or lubricants used in the metals industry for die-casting process, shell molding processes, die-forging processes, etc., consist of oils and waxes in an aqueous dispersion (suspensions or especially emulsions). To produce dispersions and emulsions of this type which remain stable, considerable amounts of emulsifier are required to avoid phase separation, i.e., the separation of the water from the oil and/or wax. The presence of such emulsifiers in agents for lubricating dies and even the presence of water in itself, however, are associated with a significant set of disadvantages.

In the conventional release and lubricating agents used to pretreat the dies used in, for example, the die-casting or die-forging of metals, the content of emulsifier based on the total solids content is in the range of 10–30%; these emulsifiers, however, are unable to contribute anything to the actual function of the release or lubricating agent and thus represent unnecessary ballast in terms of the agent's effectiveness. Some of this ballast, furthermore, remains on or in the shaped object after it has been released from the die.

In addition, because of the high water content of the known die lubricating and release agents, it is necessary to add an anticorrosive agent to prevent corrosion on the die and other machine parts such as clamping plates, which are usually made of metal. Because the conventional lubricating and release agents containing large amounts of water are sprayed on as a fine mist, even more remote machine components are exposed to the water; in addition, it has also been necessary in the past to add agents for preventing the growth of bacteria in the emulsion. Without such bactericides, the emulsions would not be stable for a long enough time. These components, however, are also unable to contribute anything to the formation of a uniform film or to the release action on the dies; on the contrary, these additives show highly negative effects. Also the salt present in water (a small amount still being present even in demineralized water) can have very negative effects on the film to be formed by the release agent on the surface of the die.

When these water-based release and lubricating agents produced with emulsifiers and other additives are used, the following problems were encountered:

1. The formation of the film is delayed by the so-called Leidenfrost phenomenon.
2. The cohesion of the film which has formed is impaired.
3. The homogeneity of the film which has formed is impaired.
4. The adhesion [of the coating to the metal] and the strength of the film are reduced.
5. The lubricating and releasing action of the film is reduced after the water has evaporated.
6. The tendency to form gas is increased and thus so is the danger of gas inclusions in the casting.

Because of these negative effects of the indispensable additives, full advantage of the release and lubricating properties of the components of the release and lubricating agents used in accordance with the state of the art can never be taken, and their film-forming properties are significantly impaired.

The present invention was therefore based on the task of providing release and lubricating agents which do not suffer from the disadvantages of the known agents and which, in addition, are extremely effective even in very small amounts and have favorable storage behavior.

This task is accomplished in accordance with the invention by water-free compositions for treating the walls of dies for original shaping or reshaping, containing up to 30% of paraffin and/or polyolefin waxes and at least 70% of oil, the oil being a silicone oil, a synthetic oil, a vegetable oil, a mineral oil, or a mixture of such oils.

The compositions according to the invention are essentially free of water. The term "water-free" within the scope of the present invention is intended to mean that at no point is water ever added to the constituents, which are used in as pure a form as possible. Extremely small amounts of water can, however, be present as a result of slight uptake of moisture from, for example, the surrounding air. These quantities, however, will usually be less than 1% of the composition, and the compositions according to the invention will preferably be stored in such a way that their water content will be less than 0.5%.

Because they are relatively anhydrous, the products according to the invention can be produced without emulsifiers, and also without an anticorrosive agent. Nor are preservatives absolutely necessary for the compositions according to the invention, but it may be advisable to add small amounts of preservatives (0–2%) to ensure especially good storage behavior.

The compositions according to the invention can be applied to the dies in the usual manner. In particular, the compositions according to the invention are capable of quickly forming especially good films after they have been sprayed on uniformly; they thus help bring about a considerable reduction in the cycle time of, for example, the die-casting process, and also help increase the production rate. Because the constituents in the composition according to the invention are present in concentrated form, only a very small amount of lubricant is required. As a result, the problem of disposing of large amounts of the waste lubricant which drips out of the die or evaporates is avoided. This in turn decreases any potential health risks to the workers in the metal-working shop which may be associated with the constituents of the compositions and also reduces environmental pollution. Because work with the release agents according to the invention is carried out without water, it should also be emphasized that the wastewater system is thus relieved of a considerable burden.

In addition, the compositions according to the invention show much improved homogeneity and stability after they have formed a film on the surface of the die and thus have better lubricating and release properties. This means that smaller forces are required to fill the dies, to open them, and to remove the shaped objects. Finally, because the films which are formed adhere better to the walls of the die, the danger that metal will remain sticking to the die is reduced, which in turn leads to an increase in the service life of the die. The cast materials or the materials shaped in the die are also cleaner, because fewer foreign materials adhere to them. As already mentioned, furthermore, only a relatively small amount of the composition according to the invention is required to achieve satisfactory lubrication of the die.

Preferred polyolefin waxes which are to be used in the invention are polyethylene, polypropylene, ethylene-propylene copolymer, and polybutene waxes. Blends of at least two of these waxes or blends with other polyolefin or paraffin waxes can be used advantageously within the scope of the present invention.

Atactic polypropylene homopolymer is especially suitable as the polypropylene.

When at least partially crystalline waxes are used, it is preferred for these to be used in thermally pretreated form in the water-free composition according to the invention.

A certain oxidation of the polyolefin waxes (up to 3% of oxygen based on the amount of polyolefin wax) is preferred and facilitates the mixing of the components of the composition according to the invention. Thus, at least partially oxidized polyolefins are therefore especially preferred waxes within the scope of the present invention.

In another preferred embodiment of the invention, polysiloxanes are used as the oil, preferably polysiloxanes with functional side groups. Especially preferred within the scope of the invention are, for example, dimethylsiloxanes, siloxanes at least partially derivatized with alkyl groupings, siloxanes at least partially derivatized with aryl groups, and siloxanes at least partially derivatized with alkylaryl groups. Even more highly polar siloxanes are also suitable, however, such as siloxanes at least partially derivatized with polyether functions.

Within the scope of the present invention, the side chains and especially the alkyl side chains contain 1–30, and preferably 3–8 carbon atoms.

Polyorganosiloxanes which have been subjected to light thermal pretreatment, polyorganosiloxanes which have been pretreated by the addition of initiators, and especially partially crosslinked polyorganosiloxanes can advantageously be present within the scope of the present invention. When these "prehardened" siloxanes are used, it is frequently observed that the film is formed more quickly and is more homogeneous.

In addition to polysiloxanes, it is also possible, however, to use mineral oils within the scope of the invention. It is irrelevant whether these are heavy or light oils. A typical example which can be cited is "heating steam-cylinder oil".

Suitable vegetable oils include, for example, castor oil, soybean oil, sunflower seed oil, and linseed oil. Examples of synthetic oils which are preferred for use within the scope of the invention are oleates such as glycerol trioleate.

Within the scope of the present invention, small amounts of additives can be used, but care must be taken to ensure that these additives do not lead to any significant impairment of the release and lubricating action of the compositions according to the invention. The amounts and the types of additives which are suitable for the water-free compositions according to the invention can be identified by the expert on the basis of his professional knowledge or can be easily determined by orientational experiments.

For example, wetting agents, bactericides, additives for improving the lubricating and release effects, and, finally, viscosity regulators can be used as additives.

Examples of wetting agents include surfactants such as ethoxylated fatty acids and ethoxylated alcohols, but care must be taken to use only suitable alcohols, namely, those which do not lead to the separation of the mixture.

Suitable bactericides include, for example, mixtures produced on the basis of hexahydrotriazine.

Additives for improving the lubricating and release properties are, for example, Teflon-like compounds, micronized siloxane resin beads, and various types of pigments, all of which are known to the expert.

As a rule, agents known in and of themselves are suitable as viscosity regulators.

In a preferred embodiment of the invention, the composition contains at least 98% of substances with a release and lubricating action, i.e., wax(es) and oil(s).

Another object of the present invention is a process for the production of the water-free compositions according to the invention. In this process, the constituents are mixed together until homogeneous. Mixing is accomplished preferably under heating.

Yet another object of the invention is the use of a water-free release/lubricating agent for treating the walls of dies for original shaping or reshaping.

For the use according to the invention, any release and/or lubricating substances are suitable in principle as long as they are water-free in accordance with the above definition of the freedom of the compositions from water. Especially suitable are synthetic oils such as silicone oils. The lubricating and release agents can also, like the compositions according to the invention, contain auxiliary materials which appear advantageous for the specific application in question. It is preferred, however, that at least 98 wt. % of the selected agent consist of substances with lubricating and releasing effects and that no more than 2 wt. % of additives or auxiliary materials such as bactericides, emulsifiers, solvents, etc., be present.

Especially preferred within the scope of the present invention is a water-free composition according to the invention as specified in the claims.

As already discussed above in detail, the water-free compositions according to the invention show especially positive properties in this application [i.e., the lubrication of dies—].

Even though the film of release agent which can be produced on the surface of the die through the use of the compositions according to the invention contains a minimum of constituents, the release properties are not impaired in any way. Quite the contrary, as discussed above, the film of release agent which is formed is more stable, more uniform, and more adherent; in addition, the film prevents the corrosion of the metal components which come in contact with the release agent. The service life of the die is also increased by the protection offered as a result of the improved release effect, and problems arising through hazards to the workers and to the environment such as the accumulation of a large amount of wastewater are also avoided.

Although the release agent can be used according to the invention by applying it to the die in any suitable manner, it is preferred within the scope of the invention that it be applied by spraying it on in the most finely divided manner possible. The agent can be applied, for example, by means of a spray element with centrifugal atomization and an air supply.

The following examples are intended to explain the invention in greater detail.

EXAMPLE 1

Vegetable soybean oil (Refined Technical Soybean Oil, Cargill B. V., Amsterdam, The Netherlands) was mixed for 30 minutes at room temperature with liquid polybutene (Polybutene L-50, Amoco Chemical Co., Chicago, USA) to form a transparent, homogeneous mixture. To protect the product from bacterial growth, a small amount of a bactericide (Forcide 8, Progiven Antiseptigues, Fontenay-sour-Bois, France) was added. The final composition of the release and lubricating agent was:

81.9 wt. % of soybean oil;

18.0 wt. % of polybutene; and 0.1 wt. % of bactericide.

EXAMPLE 2

Atactic polypropylene homopolymer (a-PP homopolymer, DSM Performance Polymers, Sittard, The Netherlands) was heated to 220° C. After the polymer was melted/softened, air was vigorously stirred into the liquid polymer under vigorous agitation to accelerate the oxidation reaction induced at high temperature.

After 20 hours at 220° C., the oxidized polymer was allowed to cool to 100° C., then the polymer was mixed with a preheated (100° C.) silicone oil functionalized with organic groups (Wacker TN, Wacker Chemie, Burghausen, Germany). The mixture was stirred for 30 minutes until a homogeneous composition was formed. After the mixture was cooled to room temperature, a small amount of bactericide (Forcide 78, Progiven Antiseptigues, Fontenay-sous-Bois, France) was added to protect against bacterial growth. The final concentration of the composition was:

84.9 wt. % of silicone oil functionalized with organic groups;

15.0 wt. % of oxidized, atactic propylene; and 0.1 wt. % of bactericide.

EXAMPLE 3

An ethylene-propylene copolymer (Eastoflex E1003D, Eastman Chemical Products, Inc., Kingsport, Tenn., USA) was heated to 200° C. After the copolymer had been melted/softened, 0.4 pph of an organic peroxide (Trigonox 101-7-5PP-pd, Akzo Nobel, Deventer, The Netherlands) was very carefully added over the course of 90 minutes under a nitrogen atmosphere to accelerate the chemical incorporation of oxygen molecules into the copolymer chains. After the addition of the peroxide, the liquid copolymer was stirred for an additional 120 minutes at 200° C., again under a nitrogen atmosphere.

To complete the oxidation, the liquid, preoxidized copolymer was heated again at 240° C. Air was introduced into the copolymer melt with vigorous stirring. After 35 hours, the oxidized copolymer was allowed to cool to 70° C., then the oxidized copolymer was stirred with liquid polybutene (Polybutene-L50, Amoco Chemical Company, Chicago, USA) in a ratio of 1:1 for 30 minutes to form a homogeneous mixture. This liquid mixture was then allowed to cool to room temperature.

The final composition of the constituents was obtained by mixing the oxidized ethylene-propylene copolymer/polybutene mixture with a synthetic glycerol trioleate oil (glycerol trioleate, Daudruy van Cauwenberghe & Fils, Dunkerque, France) for 30 minutes at room temperature. At the end of the mixing process, a small amount of bactericide (Forcide 78, Progiven, Fontenay-sous-Bois) was added to protect against bacterial growth.

The final composition was;

84.9 wt. % of glycerol trioleate;

7.5 wt. % of oxidized ethylene-propylene copolymer;

7.5 wt. % of polybutene; and 0.1 wt. % of bactericide.

We claim:

1. Water-free composition for treating the walls of a die for original shaping or reshaping, comprising in weight percent, about 7% to 30% of at least one wax material selected from the group consisting of polyethylene, polybutene, polypropylene, and ethylene-propylene copolymer, and at least 70% to about 93% of a silicone oil selected from a least one of the group consisting of silicone oil, vegetable oil, and mineral oil.

2. The composition according to claim 1, characterized in that the wax is an atactic polypropylene homopolymer.

3. The composition according to claim 1, wherein said wax is further oxidized with up to 3 wt. % of oxygen.

4. The composition according to claim 2, wherein said oil is a polyorganosiloxane functionalized with side groups of alkyl, aryl, alkylaryl, or polyether groupings containing 1–30 carbon atoms.

5. The composition according to claim 4, characterized in that the side groups contain 3–8 carbon atoms.

6. The composition according to claim 5, characterized in that said composition contains a partially crosslinked silicone oil.

7. The composition according to claim 3, characterized in that said composition also includes a small effective amount of at least one additive material selected from the group consisting of a wetting agent, a preservative, and a viscosity regulator.

8. The composition according to claim 7, characterized in that the composition contains at least 98% of substances with lubricating and release effects.

9. A process for the production of a water-free composition according to claim 1, comprising the steps of: blending said oil with said wax until a homogeneous mixture is obtained, and applying heat to said composition while the blending is being carried out.

10. A method of use for treating the walls of a die for original shaping or reshaping with a water-free lubricating release composition, comprising the step of: treating the walls of a die for original shaping or reshaping by applying a water-free composition comprising in weight percent, about 7% to 30% of at least one wax material selected from the group consisting of polyethylene, polybutene, polypropylene, and ethylene-propylene copolymer, and at at least 70% to about 93% of a silicone oil.

11. The method of claim 10, wherein said wax is an atactic polypropylene homopolymer.

12. The method of claim 10, wherein said wax is further oxidized with up to 3 wt. % of oxygen.

13. The method of claim 10, wherein said composition also includes a small effective amount of at least one additive material selected from the group consisting of a wetting agent, a preservative, and a viscosity regulator.

* * * * *

UNITED STATES PATENT AND TRADEMARK OFFICE

CERTIFICATE OF CORRECTION

PATENT NO. : 6,040,278

DATED : March 21, 2000

INVENTOR(S) : Douwe Marten Kok and Harold Gankema

It is certified that error appears in the above-identified patent and that said Letters Patent are hereby corrected as shown below:

In claim 1, at line 6, insert a period (.) after "silicone oil"; and <u>delete</u> the remaining two lines of the claim. [This change should be made pursuant to page 2 of the Examiner's Amendment mailed 11/05/99].

Signed and Sealed this

Tenth Day of April, 2001

*Attest:*

Nicholas P. Godici

NICHOLAS P. GODICI

*Attesting Officer*

*Acting Director of the United States Patent and Trademark Office*